US005239731A

United States Patent [19]

Lu

[11] Patent Number: 5,239,731

[45] Date of Patent: Aug. 31, 1993

[54] HINGE DEVICE FOR CASINGS

[76] Inventor: Sheng N. Lu, No. 174, Chun Ying St., Shu Lin Chen, Taipei Hsien, Taiwan

[21] Appl. No.: 893,040

[22] Filed: Jun. 3, 1992

[51] Int. Cl.[5] ..... E05D 11/08

[52] U.S. Cl. ..... 16/340; 16/342

[58] Field of Search ..... 16/340, 341, 342, 337; 361/380

[56] References Cited

U.S. PATENT DOCUMENTS

| | | | |
|---|---|---|---|
| 1,956,040 | 4/1934 | Meyer | 16/340 |
| 2,736,027 | 2/1956 | Parmelee | 16/340 |
| 4,829,633 | 5/1989 | Kassner | 16/340 |
| 5,031,270 | 7/1991 | Lee | 16/341 |

*Primary Examiner*—Mark Rosenbaum
*Assistant Examiner*—Chuck Y. Mah
*Attorney, Agent, or Firm*—Oblon, Spivak, McClelland, Maier & Neustadt

[57] ABSTRACT

A hinge device for a casing of the type having a body portion and an upper cover includes a substantially L-shaped mount plate adapted to be securely mounted to the body portion of the casing, a sleeve attached to a first side of the mount plate, a pivotal axle having a conic portion thereof received in the sleeve and a flange portion against the sleeve, a spring, and a nut mounted on the pivotal shaft and located on a second side of the mount plate. The nut biases the spring allowing the pivotal axle to be freely pivotable relative to the spring. When a desired position of the upper cover relative to the body portion of the casing is reached, the spring biased by the nut exerts a longitudinal force on the pivotal axle to retain the pivotal axle in position.

5 Claims, 1 Drawing Sheet

HINGE DEVICE FOR CASINGS

BACKGROUND OF THE INVENTION

The present invention relates to a hinge device for casings and, more particularly, to an improved hinge device for casings of the type comprised of an upper cover and a body portion.

Many hinge devices are used in casings, such as portable computers, of the type having an upper cover and a body portion, to discretionally retain the upper cover in a desired position relative to the body portion by friction. However, such hinge devices tend to malfunction after long-term usage. For example, one type of the hinge devices utilizes a spring around a pivotal axle, and by means of the friction between the tightly-contacted surface of an inner periphery of the spring and an outer periphery of the pivotal axle to achieve the above-mentioned purpose. However, after long-term usage, the spring and the pivotal axle are unable to provide a sufficiently tight contact relationship therebetween due to abrasion.

Therefore, there has been a long and unfulfilled need for an improved hinge device to mitigate and/or obviate the aforementioned problems.

SUMMARY OF THE INVENTION

The present invention provides a hinge device for a casing having a body portion and an upper cover, including a substantially L-shaped mount plate, a sleeve, a pivotal axle, a washer, a spring, and a nut. The L-shaped mount plate has a vertical portion with a hole and a horizontal portion adapted to be securely mounted to the body portion of the casing. The sleeve has a conic hole extending along a longitudinal direction thereof. The sleeve is attached to a first side of the vertical portion with the conic hole thereof aligning with the hole in the vertical portion. The pivotal axle includes a mounting portion located at the first side of the vertical portion and adapted to be securely mounted to the upper cover of the casing, a flange, a conic portion fittingly and pivotally received in the conic hole of the sleeve, and an extension with a threaded end portion. The washer is attached to a second side of the vertical portion of the mount plate. The spring is mounted around the extension of the pivotal axle. The nut is mounted on the threaded end portion of the extension to bias the spring between the nut and the washer.

Under such an arrangement, the pivotal axle is freely pivotable relative to the spring, yet when a desired position of the upper cover relative to the body portion of the casing is reached, the spring biased by the nut exerts a longitudinal force on the pivotal axle, such that the flange of the pivotal axle is against the sleeve, thereby retaining the pivotal axle in position.

The hinge device may have a restraining member provided in an inner side of the nut. The restraining member having a protrusion projecting from an outer periphery thereof, such that when the upper cover of the casing is opened to a preset maximum angle relative to the body portion of the casing, the protrusion contacts with and is stopped by a stop extending from the vertical portion of the mount plate.

Other advantages and novel features of the invention will become more apparent from the following detailed description when taken in conjunction with the accompanying drawings.

DETAILED DESCRIPTION OF THE PREFERRED EMBODIMENTS

Figure 1:
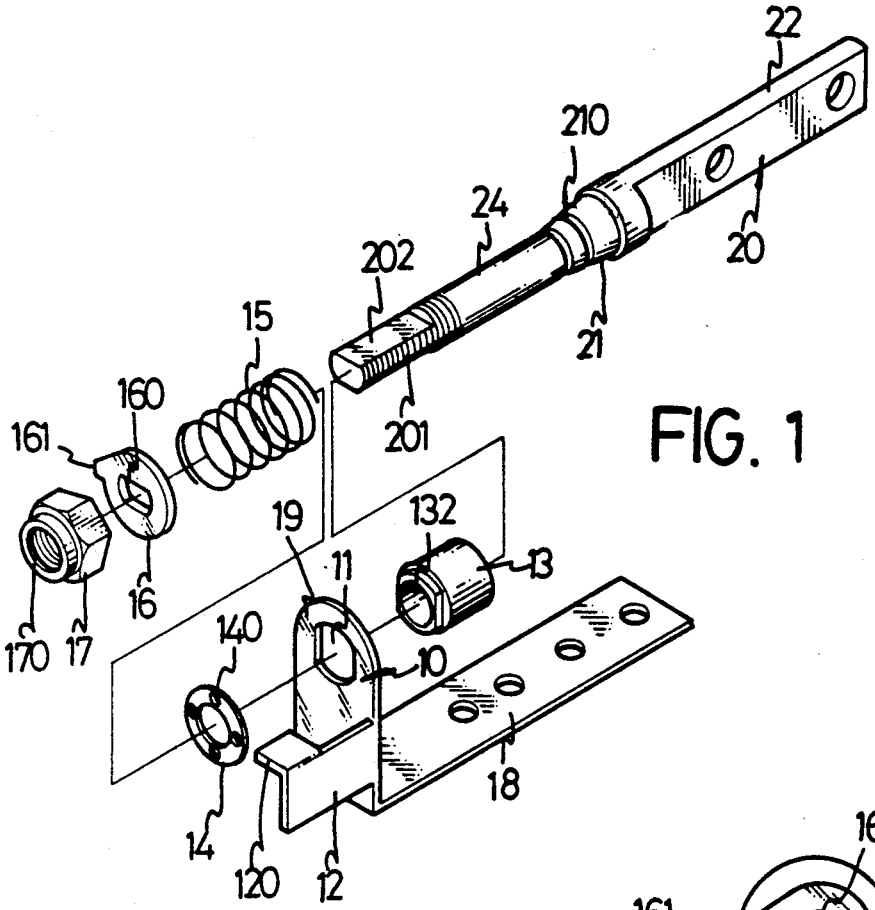
FIG. 1 is an exploded view of a hinge device in accordance with the present invention.
Figure 2:
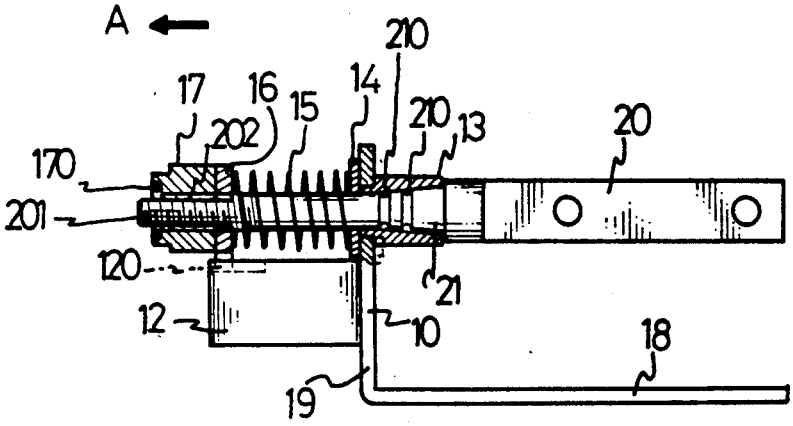
FIG. 2 is a partial cross-sectional view of the hinge device.

Referring to the drawings and initially to FIGS. 1 and 2, a hinge device in accordance with the present invention generally includes a substantially L-shaped mount plate 10 which has a vertical portion 19 to which a sleeve 13 is securely mounted and a horizontal portion 18 adapted to be securely mounted to a body portion of a casing (not shown), such as a portable computer or the like. The vertical portion 19 has a hole 11 for securely mounting the sleeve 13 therein. As shown in FIGS. 1 and 2, the sleeve 13 has a conic hole 132 extending along a longitudinal direction thereof.

The hinge device further has a pivotal axle 20 passing through the sleeve 13. The pivotal axle 20 includes a mounting portion 22 adapted to be securely mounted to an upper cover (not shown) of the above-mentioned casing, a flange portion 26, a conic portion 21 extending from the flange portion 26 and being fittingly and pivotally received in the conic hole 132 of the sleeve 13, and an extension 24 with a threaded end portion 201 extending from the conic portion 21. The hinge device further has a washer 14, a spring 15, a restraining member 16, and a nut 17. As clearly shown in FIG. 2, the sleeve 13 is mounted to one side of the vertical portion 19 of the mount plate 10 with the conic hole 132 thereof aligning with the hole 11 of the vertical portion 19. The pivotal axle 20 passes through the sleeve 13 with the conic portion 21 thereof pivotally received in the conic hole 132 of the sleeve 13 and with the threaded end portion 201 extending to the other side of the vertical portion of the mount plate 10. Directly attached to the other side of the vertical portion of the mount plate is the washer 14. Thereafter, the spring 15 is mounted around the extension 24 of the pivotal axle 20. Then the restraining member 16 and the nut 17 are assembled on the threaded end portion 201. The nut 17 is screwed inward to bias the spring 15.

When a user intends to open the casing, the upper cover thereof is opened by means of a pivotal movement of the pivotal axle 20 relative to the mount plate 10. During the pivotal movement, the pivotal axle 20 is freely pivotable relative to the spring 15. When a desired position of the upper cover relative to the body portion of the casing is reached, the user releases the upper cover and the upper cover is positioned. This is because the vertical portion 19 of the mount plate 10 is fixed, and the spring 15 which is biased by the nut 17 exerts a longitudinal force on the pivotal axle 20 (see the arrow A in FIG. 2), and such a force is sufficient to retain the pivotal axle 20 in position (by means of the flange portion 26 of the pivotal axle 20 against the sleeve 13). Additionally, two oil gaps 210 are formed in an outer periphery of the conic portion 21 to provide a smooth pivotal movement. Oil holes 140 may be provided in the washer 14 to provide a smooth contact surface between the washer 14 and the vertical portion of the mount plate 10. Furthermore, a gasket 170 can be provided in the nut 17 around the threaded end portion 201 to provide an assist to retain the pivotal axle 20 in position.

Figure 3:
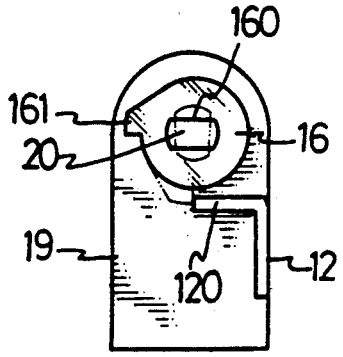
FIG. 3 is a schematic side view of the hinge device.

Referring now to FIG. 3, the restraining member 16 has a protrusion 161 projecting from an outer periphery thereof. When the upper cover of the casing is opened to a pre-set maximum angle relative to the body portion of the casing (see the phantom lines), the protrusion 161 contacts with and is stopped by a stop 120 of a plate 12 extending from the vertical portion 19 of the mount plate 10.

In the embodiment of the present invention the threaded end portion 201 is cut to form two opposite planar surfaces 202, and the retaining member 16 has a corresponding hole 160. Nevertheless, it is appreciated that many other modifications can be made without departing from the principle of the invention.

Although the invention has been explained in relation to its preferred embodiment, it is to be understood that many other possible modifications and variations can be made without departing from the spirit and scope of the invention as hereinafter claimed.

I claim:

1. A hinge device for a casing having a body portion and an upper cover, comprising:

a substantially L-shaped mount plate having a vertical portion with a hole and a horizontal portion adapted to be securely mounted to said body portion of said casing;

a sleeve having a conic hole extending along a longitudinal direction thereof, said sleeve being attached to a first side of said vertical portion with said conic hole thereof aligning with said hole;

a pivotal axle comprising a mounting portion located at said first side of said vertical portion and adapted to be securely mounted to said upper cover of said casing, a flange portion also located at said first side of said vertical portion, a conic portion extending from said flange portion and being fittingly and pivotally received in said conic hole of said sleeve, and an extension extending from said conic portion at a second side of said vertical portion and having a threaded end portion;

a washer attached to said second side of said vertical portion of said mount plate;

spring mounted around said extension of said pivotal axle; and a nut mounted on said threaded end portion of said extension to bias said spring between said nut and said gasket;

whereby said pivotal axle is freely pivotable relative to said spring, and when a desired position of said upper cover relative to said body portion of said casing is reached, said spring biased by said nut exerts a longitudinal force on said pivotal axle, such that said flange portion of said pivotal axle is against said sleeve, thereby retaining said pivotal axle in position.

2. The hinge device as claimed in claim 1, further comprising a restraining member provided to an inner side of said nut, said restraining member having a protrusion projecting from an outer periphery thereof, and a stop extending from said vertical portion of said mount plate, such that when said upper cover of said casing is opened to a pre-set maximum angle relative to said body portion of said casing, said protrusion contacts with and is stopped by said stop.

3. The hinge device as claimed in claim 2, wherein two oil gaps are formed in an outer periphery of said conic portion to provide a smooth pivotal movement.

4. The hinge device as claimed in claim 2, wherein a plurality of oil holes are provided in said washer to provide a smooth contact surface between said washer and said vertical portion of said mount plate.

5. The hinge device as claimed in claim 1, further comprising a gasket provided in said nut around said threaded end portion to provide an assist to retain said pivotal axle in position.

* * * * *